US012545501B2

(12) United States Patent
Hardy et al.

(10) Patent No.: US 12,545,501 B2
(45) Date of Patent: Feb. 10, 2026

(54) REMOVEABLE CONTAINER TRACKING ENCLOSURE

(71) Applicant: Dayton Innovation Partners, LLC, Dayton, OH (US)

(72) Inventors: Alexander Hardy, Dayton, OH (US); John Pulaski, Chicago, IL (US); Ryan Rasmussen, Crestwood, KY (US); Matthew Spencer, Troy, OH (US); Ryan Secrest, New Albany, OH (US); Kaleb Xander Vance, Lakeview, OH (US); Khalid Zouhri, Dayton, OH (US); Rebecca Blust, Dayton, OH (US)

(73) Assignee: Dayton Innovation Partners, LLC, Dayton, OH (US)

( * ) Notice: Subject to any disclaimer, the term of this patent is extended or adjusted under 35 U.S.C. 154(b) by 43 days.

(21) Appl. No.: 18/615,449

(22) Filed: Mar. 25, 2024

(65) Prior Publication Data

US 2024/0317487 A1 Sep. 26, 2024

Related U.S. Application Data

(60) Provisional application No. 63/454,281, filed on Mar. 23, 2023.

(51) Int. Cl.

| | |
|---|---|
| ***B65D 90/22*** | (2006.01) |
| ***B65D 88/12*** | (2006.01) |
| ***B65D 90/00*** | (2006.01) |

(52) U.S. Cl.
CPC ..... *B65D 90/22* (2013.01); *B65D 88/121* (2013.01); *B65D 90/0026* (2013.01)

(58) Field of Classification Search
CPC .. H05K 13/084; H05K 13/087; H05K 7/1498; G09F 3/00; H02G 3/08; H02G 3/081; H02G 3/086; B65D 90/22; B65D 88/121; B65D 90/0026; B65D 2590/0083; B65D 90/00
See application file for complete search history.

(56) References Cited

U.S. PATENT DOCUMENTS 3,189,212 A * 6/1965 Bellek ..... H01R 13/447 174/67
7,854,372 B1 * 12/2010 Bartone, Sr. ..... B65D 5/4283 24/546

(Continued)

*Primary Examiner* — Kareen K Thomas
(74) *Attorney, Agent, or Firm* — Taft Stettinius & Hollister LLP; Derek B. Lavender

(57) ABSTRACT

The present disclosure is a removeable container tracking enclosure assembly that has a body defining an interior cavity configured to house electronics, a pivot assembly coupled to the body on one end and providing a pivot coupler on another end, the pivot coupler being pivotable relative to the body, and a face plate selectively coupled to the pivot coupler with a fastener. The fastener is coupleable to the pivot coupler at an install length and a secured length. The body is sized to fit through an opening in a corner casting when the fastener is at the install length. The body is sized to selectively span the opening to be secured therein when oriented in a secured position. Further, the body is selectively locked in the secured position with the fastener at the secured length by compressing a portion of the corner casting between the face plate and the body.

20 Claims, 6 Drawing Sheets

(56) References Cited

U.S. PATENT DOCUMENTS

| | | | | |
|---|---|---|---|---|
| 8,104,639 | B1 * | 1/2012 | Cleghorn | H01H 9/02 174/67 |
| 8,827,226 | B2 * | 9/2014 | Townsend | F16M 11/2092 248/920 |
| 10,446,002 | B2 * | 10/2019 | Miettinen | G08B 13/1463 |
| 10,450,775 | B2 * | 10/2019 | Cagan | E05B 17/226 |
| 2004/0100379 | A1 * | 5/2004 | Boman | G06Q 10/06 340/521 |
| 2005/0231365 | A1 * | 10/2005 | Tester | G09F 3/0347 292/307 R |
| 2011/0286197 | A1 * | 11/2011 | Jaeger | B65D 90/00 361/825 |
| 2015/0318678 | A1 * | 11/2015 | Ketterer | E05D 5/02 16/249 |
| 2018/0039872 | A1 * | 2/2018 | Liao | G06K 19/0704 |
| 2020/0317500 | A1 * | 10/2020 | Belkhir | B01F 33/846 |

* cited by examiner

REMOVEABLE CONTAINER TRACKING ENCLOSURE

CROSS-REFERENCE TO RELATED DISCLOSURE

The present disclosure claims the benefit of U.S. Provisional Application No. 63/454,281 filed Mar. 23, 2023, the contents of which are incorporated herein in entirety.

FIELD OF THE DISCLOSURE

The present disclosure relates to a container tracking enclosure and more specifically to a container tracking enclosure that can selectively couple to a corner casting of a shipping container.

BACKGROUND OF THE DISCLOSURE

Shipping containers are commonly used around the world to ship goods. Shipping containers have standard configurations that are governed by the International Organization for Standardization ("ISO"). The ISO regulates standard sizes for shipping containers along with other features of the shipping container such as corner castings. In one example, a standard shipping container is regulated through ISO 55.180.10 and ISO 1161 specifically outlines corner castings. Standard shipping containers can be moved between different transport means, such as cargo ships, planes, and trucks, throughout the transport process.

There is a need for a removeable container tracking enclosure that can easily and securely be selectively coupled to a shipping container so electronics within the enclosure can track and broadcast the container location, among other things.

SUMMARY

One embodiment is a removeable container tracking enclosure assembly that has a body defining an interior cavity configured to house electronics, a pivot assembly coupled to the body on one end and providing a pivot coupler on another end, the pivot coupler being pivotable relative to the body, and a face plate selectively coupled to the pivot coupler with a fastener. The fastener is coupleable to the pivot coupler at an install length and a secured length. The body is sized to fit through an opening in a corner casting when the fastener is at the install length. The body is sized to selectively span the opening to be secured therein when oriented in a secured position. Further, the body is selectively locked in the secured position with the fastener at the secured length by compressing a portion of the corner casting between the face plate and the body.

One example of this embodiment is a cap that is selectively coupleable to the body, the cap sized to substantially seal the interior cavity of the body when coupled thereto. In another example of this embodiment, the face plate has a convex profile configured to provide a minimal edge when coupled to the corner casting. In yet another example, the fastener has a security feature that requires a security tool to transition the fastener between the install length and secured length. In another example, the body has a tapered edge that is configured to allow the body to transition into the secured position within the corner casting. In yet another example, the pivot coupler has a threaded portion defined partially therein and the fastener is threadably repositionable therein as the fastener transitions between the install length and the secured length. In yet another example, the pivot assembly comprises a hinge formed from a pivotal connection between the pivot coupler and body.

In yet another example of this embodiment, the body houses tracking electronics configured to track the location of the enclosure assembly. In part of this example, the tracking electronics wirelessly broadcast location data. In another part of this example, the tracking electronics store location data in a memory unit. In yet another part of this example, the tracking electronics provide real-time data to a remote device.

Another embodiment may be a removeable container tracking enclosure assembly that has a body having a tapered edge, the body defining an interior cavity configured to house electronics, a pivot assembly coupled to the body on one end and providing a pivot coupler on another end, the pivot coupler being pivotable relative to the body, and a face plate selectively coupled to the pivot coupler with a fastener. The tapered edge of the body is configured to allow the body to pivot about the pivot assembly relative to the faceplate to an install position wherein the body can be positioned through a corner casting.

In an example of this embodiment, the taper of the body is configured to allow the body to pivot relative to the face plate to a secured position wherein the face plate is positioned on an exterior side of the corner casting and the body is positioned on an interior side of the corner casting. In part of this example, the container tracking enclosure assembly is substantially fixed to the corner casting in the secured position.

In another example of this embodiment, the fastener is coupleable to the pivot coupler at an install length and a secured length, wherein the body is sized to fit through an opening in a corner casting when the fastener is at the install length. In part of this example, the body is configured to be selectively locked in the secured position with the fastener at the secured length by compressing a portion of the corner casting between the face plate and the body.

Another example of this embodiment has a cap that is selectively coupleable to the body, the cap sized to substantially seal the interior cavity of the body when coupled thereto. In yet another example, the face plate has a convex profile configured to provide a minimal edge when coupled to the corner casting. In another example, the fastener has a security feature that requires a security tool to transition the fastener between the install length and secured length.

Another embodiment of this disclosure is a method for installing a removeable container tracking enclosure assembly to a corner casting of a container. The method includes coupling a face plate to a body through a fastener coupled to a pivot assembly, the fastener coupled to the pivot assembly at an install length, pivoting the body relative to the face plate to an install position wherein the body has an offset angle relative to the face plate, positioning the body through an opening in the corner casting while in the install position, repositioning the body to a secured position wherein the face plate is positioned on an exterior side of the corner casting and the body is positioned on an interior side of the corner casting, and transitioning the fastener to a secured length within the pivot assembly to compress a portion of the corner casting between the face plate and the body.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals indicate corresponding parts throughout the several views.

DETAILED DESCRIPTION

The embodiments of the present disclosure described below are not exhaustive and do not limit the disclosure to the precise forms in the following detailed description. Rather, the embodiments are chosen and described so that others skilled in the art may appreciate and understand the principles and practices of the present disclosure.

Figure 1:
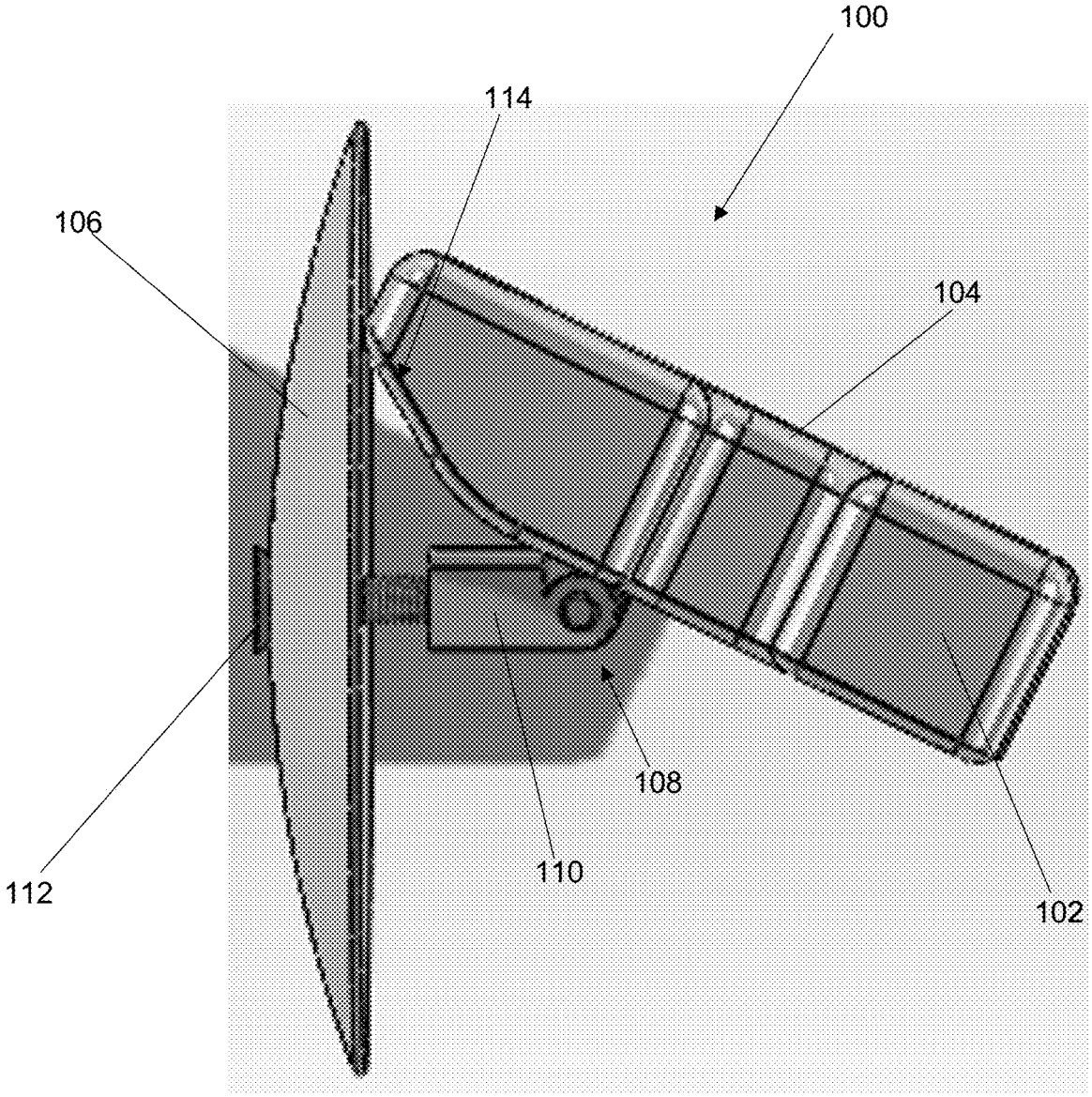
FIG. 1 is a top view of one embodiment of a container tracking enclosure assembly.

FIG. 1 illustrates a container tracking enclosure assembly 100 that is configured to selectively couple the enclosure assembly to a container 500 having corner castings 502. The enclosure assembly 100 is configured to house electronics 604 within an interior cavity 606 formed, in part, by a body 102. The electronics 606 may include wireless receiver/transmitters, one or more controller, one or more memory unit, and one or more positioning system, among other things. This disclosure contemplates positioning other electronics 606 in the interior cavity 606 of the body 102 as well.

A cap 104 may be selectively coupleable to the body to fully enclose the interior cavity 606. The cap 104 may have a seal 602 positioned along a perimeter between the cap 104 and the body 102 to ensure the interior cavity 606 is substantially fluidly sealed from an external environment when the cap 104 is coupled to the body 102. In this configuration, any electronic components positioned within the interior cavity 606 may be protected from moisture, among other things, in the external environment when the cap 104 is coupled to the body 102.

In one aspect of this disclosure, the cap 104 and body 102 may be formed of a material that does not substantially interfere or minimize the strength of wireless signals. In one example, the body 102 and cap 104 are formed from a synthetic material such as plastic. However, other materials are also contemplated herein.

Figure 4:
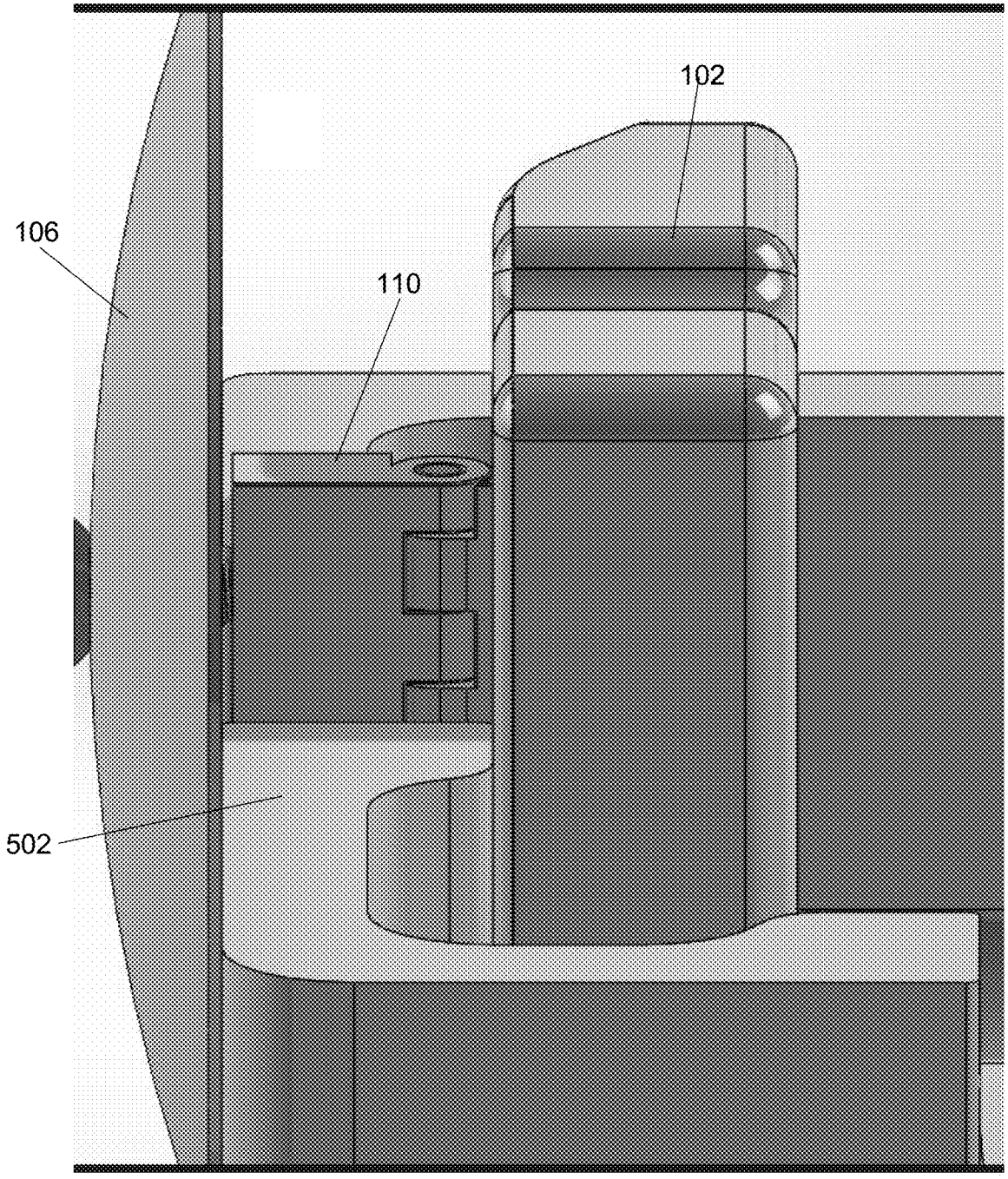
FIG. 4 is an elevated side view of the enclosure assembly of FIG. 2*a* in the secured position.
Figure 5:
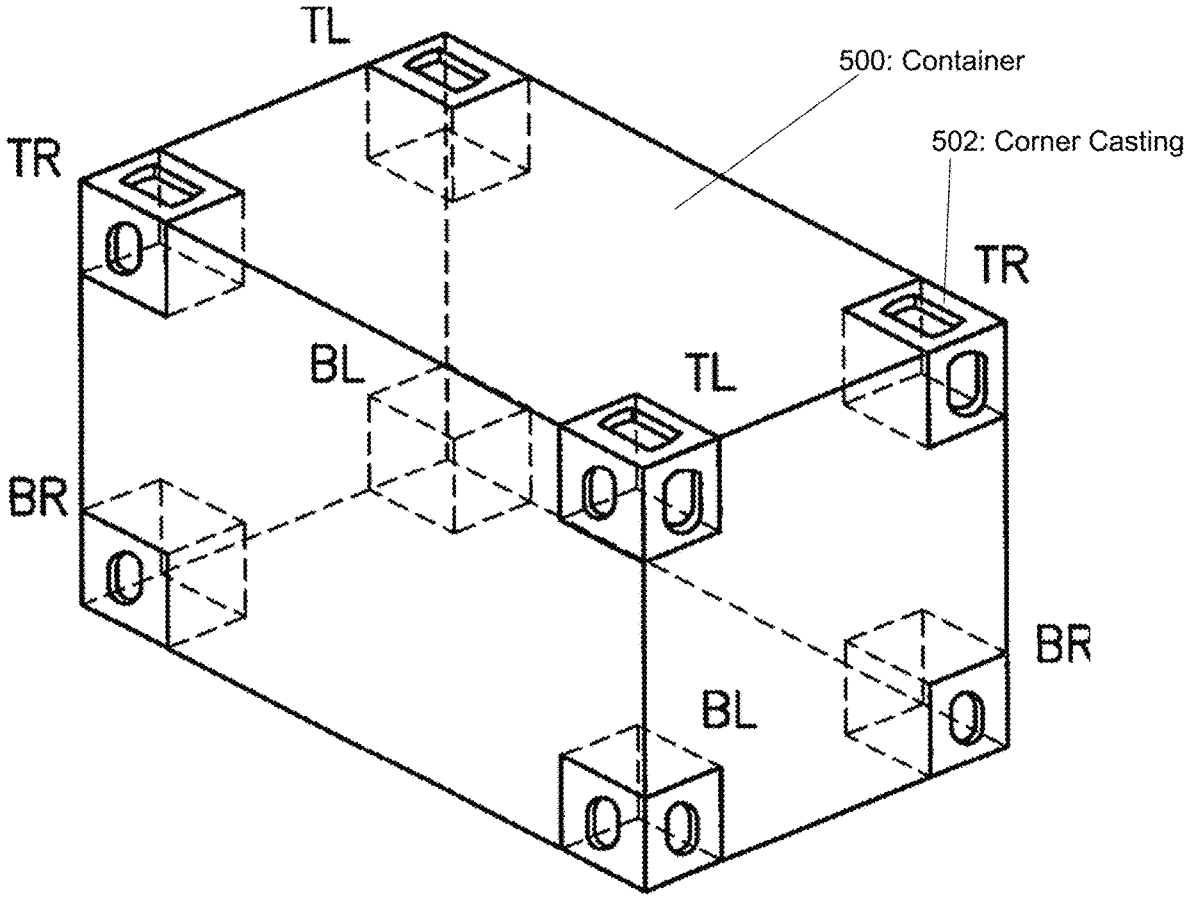
FIG. 5 is an exemplary embodiment of a standard container having corner castings.
Figure 6:
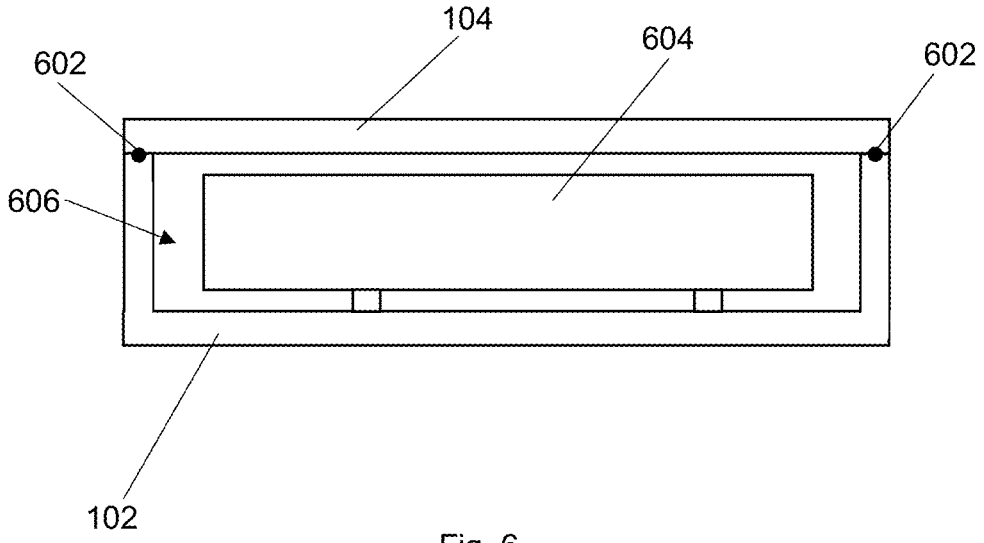
FIG. 6 is a section view of a body of the container tracking enclosure assembly of FIG. 1.

The enclosure assembly 100 may have a face plate 106 configured to be selectively coupled to a pivot assembly 108 to be pivotal relative to the body 102. More specifically, the pivot assembly 108 may be formed of a hinge having hinge elements formed from, or otherwise coupled to, the body 102 and hinge elements formed from a pivot coupler 110. The pivot coupler 110 may be selectively coupled to the face plate 106 through a fastener 112. In one part of this disclosure, the fastener 112 may be threadably coupled to the pivot coupler 110 through a threaded partial through hole defined in the pivot coupler 110. The threaded partial through hole may have a sufficient length to permit the fastener 112 to be coupled thereto at an install length wherein the face plate 106 may be sufficiently spaced from the body 102 to allow the face plate 112 to pivot into an install orientation as illustrated in FIG. 1. The threaded partial through hole may also be sized to allow the fastener 112 to be threaded sufficiently into the pivot coupler to space the face plate 106 in a secured position. The secured position is illustrated in FIG. 4. In the secured positioned, the fastener 112 may be in tension as the face plate 112 and body 102 compress a portion of the corner casting there between.

The body 102 may also have a tapered edge 114 along one edge thereof. The tapered edge 114 may be a section of the body that tapers away from a planar surface of the body as the tapered edge 114 approaches the adjacent side of the body 102. The tapered edge 114 may provide additional clearance for the body 102 to be angled relative to the face plate 112 to allow the body to fit within a corner casting 502 as discussed herein (see FIGS. 2*a*-2*d*). Further, the tapered edge 114 may also guide the body 102 from an angled configuration relative to the face plate 112 (see FIGS. 2*a*-2*c*) to a parallel configuration relative to the face plate 112 (see FIG. 2*d*) through contact with an interior wall of the corner casting 502 during install. In other words, the tapered edge 114 allows the body 102 to be angled relative to the face plate 112 to fit into the corner casting 502 and to be guided into the secured position of FIG. 2*d* during installation.

Figure 2A:
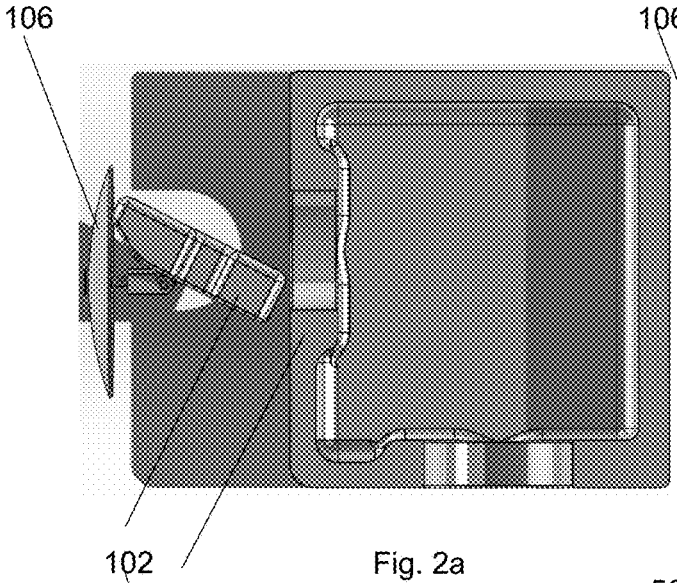
FIG. 2*a* is a top view of the enclosure assembly with a fastener at an install length and a body of the enclosure assembly rotated relative to a face plate to an install position.
Figure 2B:
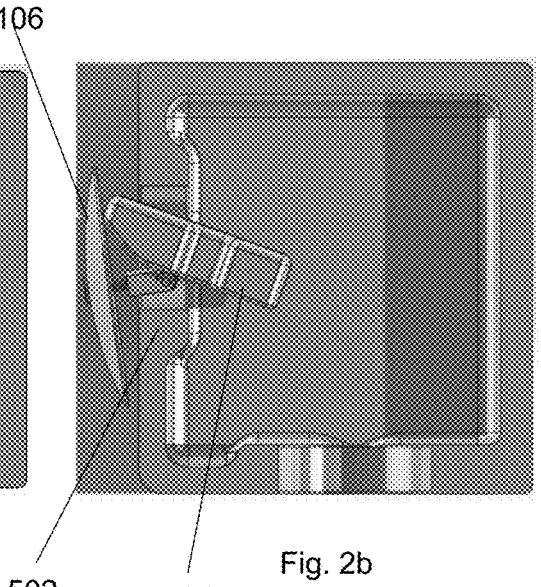
FIG. 2*b* is a top view of the enclosure assembly of FIG. 2*a* transitioning through an opening of a corner casting.
Figure 2C:
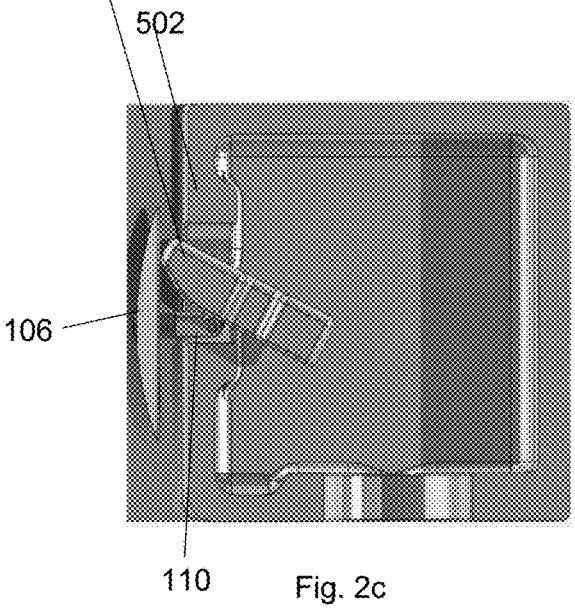
FIG. 2*c* is a top view of the enclosure assembly of FIG. 2*a* with the face plate approaching a planar surface of the corner casting.

Referring now to FIGS. 2*a*-2*d*, one exemplary method of installing the enclosure assembly 100 to a corner casting 502 is illustrated. The corner casting 502 of FIGS. 2*a*-2*d* is illustrated in a section view with the top half removed to clearly illustrate the spacing of the opening through which the enclosure assembly 100 is being positioned. In FIG. 2*a*, the enclosure assembly 100 is illustrated in the install position wherein the body 102 is angled relative to the face plate 106. In the install orientation, the body 102 may fit within a hole of the corner casting 502 as illustrated in FIG. 2*b*. More specifically, in the install orientation the body 102 may be maneuvered through the hole of the corner casting 502 as illustrated in FIGS. 2*b*-2*c*. As illustrated in FIG. 2*c*, the body 102 may be positioned so the pivot couple 110 is substantially adjacent to a wall of the corner casting 502. In this orientation, and with the fastener 112 at the install length, the body 502 may be able to transition entirely through the hole of the corner casting 502.

Once the body 102 is positioned through the hole of the corner casting 502, the body 102 may be pivoted to provide an adjacent surface that is parallel with an inner surface of the corning casting 502. Once in this orientation, the enclosure assembly 100 may slide so the pivot coupler 110 is spaced from the wall of the corner casting 502 such that the body 102 is substantially bridging the hole of the corner casting 502. Once in the orientation of FIG. 2*d*, the fastener 112 may be transitioned to the secured length to compress the corner casting 502 between the body 102 and the face plate 106. Once the fastener 112 is transitioned to the secured length, the body 102 may be substantially immovably coupled to the corner casting 502 in a secured position.

Figure 2D:
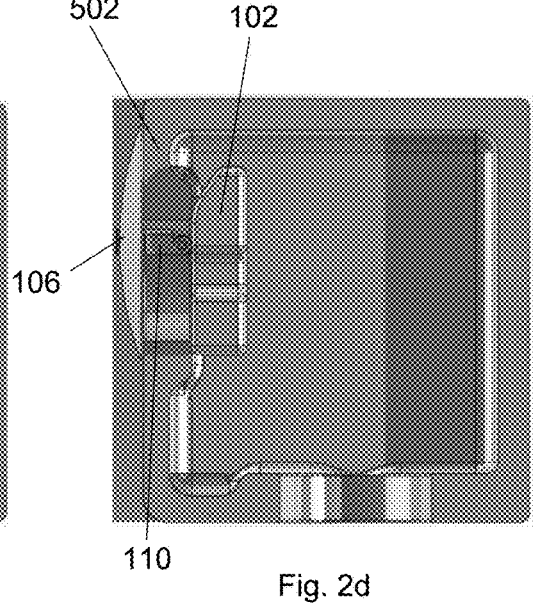
FIG. 2*d* is a top view of the enclosure assembly of FIG. 2*a* in a secured position wherein the fastener is at a secured length to compress a portion of the corner casting between the face plate and the body.
Figure 3:
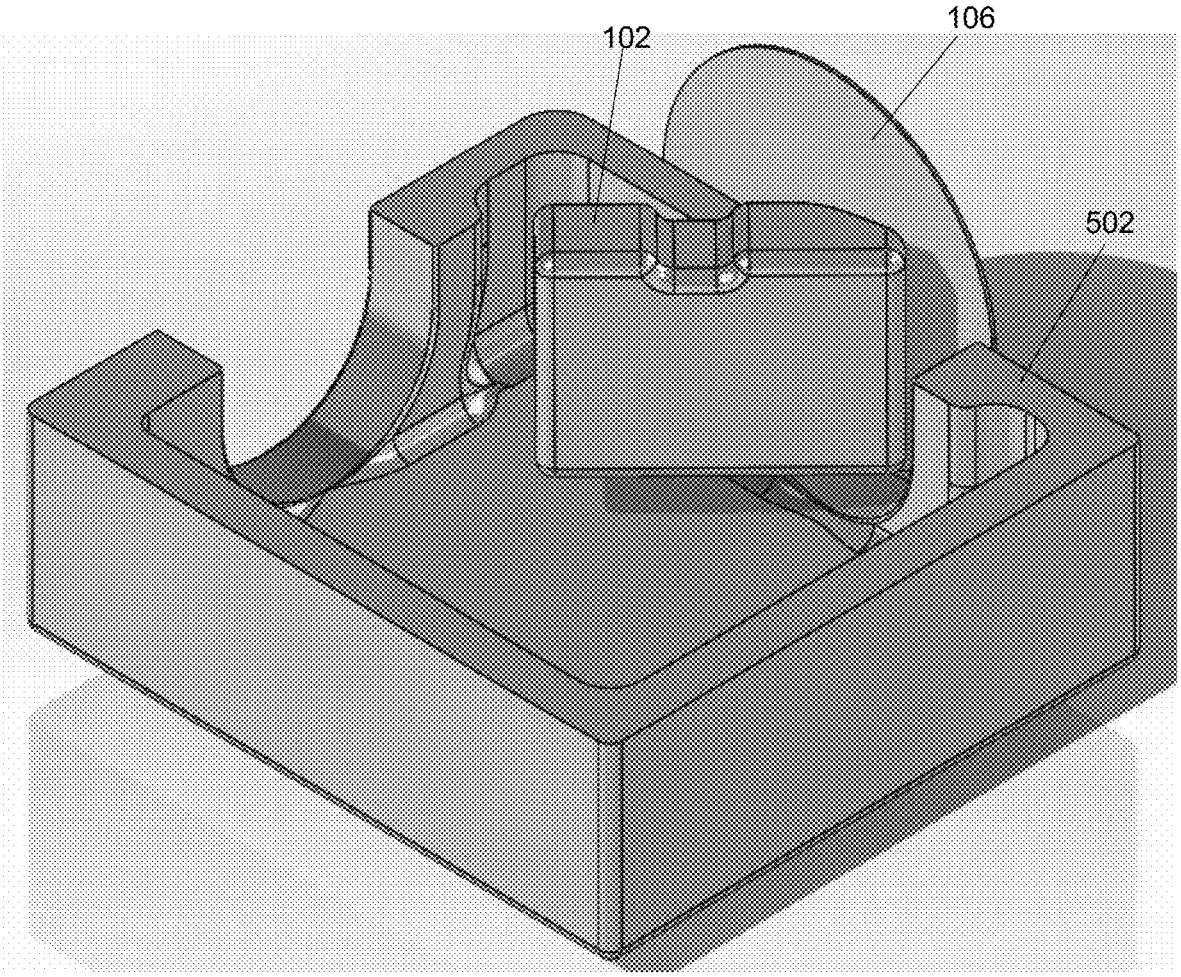
FIG. 3 is an elevated perspective view of the tracking enclosure from FIG. 2*a* transitioning into the corner casting.

When the body 102 is in the secured position as illustrated in FIG. 2*d*, the face plate 102 may substantially cover the adjacent hole of the corner casting 502 such that the hole is not visible from the outer perspective. This configuration may substantially prevent the enclosure assembly 100 from being removed from the corner casting 502 once oriented in the secured position. Further still, the fastener 112 may have a security feature wherein the fastener 112 can only be transitioned between the secured length and the install length with a security tool. The security tool may be a tool that is specifically designed to couple with the fastener 112. In one example, the fastener 112 may have a security torx head and the security tool may have a security torx coupler. However, other security configurations are contemplated herein.

The enclosure assembly 100 may be specifically sized to house electronics 606 capable of monitoring and recording location data among other things. In one example, the electronics 606 include a transmitter and/or receiver for wirelessly communicating data, a controller for processing data and executing commands, a memory unit for storing data and executable commands, and a positioning system among other things. In use, the enclosure assembly 100 may be selectively coupled to the corner casting 502 of a container 500 to allow the electronics 606 positioned therein to track the location of the container 500 and send location data about the container to a remote user.

While this disclosure has been described with respect to at least one embodiment, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A removeable container tracking enclosure assembly, comprising:

a body defining an interior cavity configured to house electronics;

a pivot assembly coupled to the body on one end and providing a pivot coupler on another end, the pivot coupler being pivotable relative to the body; and a face plate selectively coupled to the pivot coupler with a fastener;

wherein, the fastener is coupleable to the pivot coupler at an install length and a secured length;

wherein the body is sized to fit through an opening in a corner casting when the fastener is at the install length;

wherein the body is sized to selectively span the opening to be secured therein when oriented in a secured position;

wherein the body is configured to be selectively locked in the secured position with the fastener at the secured length by compressing a portion of the corner casting between the face plate and the body.

2. The enclosure assembly of claim 1, comprising a cap that is selectively coupleable to the body, the cap sized to substantially seal the interior cavity of the body when coupled thereto.

3. The enclosure assembly of claim 1, wherein the face plate has a convex profile configured to provide a minimal edge when coupled to the corner casting.

4. The enclosure assembly of claim 1, wherein the fastener has a security feature that requires a security tool to transition the fastener between the install length and secured length.

5. The enclosure assembly of claim 1, wherein the body has a tapered edge that is configured to allow the body to transition into the secured position within the corner casting.

6. The enclosure assembly of claim 1, wherein the pivot coupler has a threaded portion defined partially therein and the fastener is threadably repositionable in the threaded portion as the fastener transitions between the install length and the secured length.

7. The enclosure assembly of claim 1, wherein the pivot assembly comprises a hinge formed from a pivotal connection between the pivot coupler and body.

8. The enclosure assembly of claim 1, wherein the body houses tracking electronics configured to track the location of the enclosure assembly.

9. The enclosure assembly of claim 8, wherein the tracking electronics wirelessly broadcast location data.

10. The enclosure assembly of claim 8, wherein the tracking electronics store location data in a memory unit.

11. The enclosure assembly of claim 8, wherein the tracking electronics provide real-time data to a remote device.

12. A removeable container tracking enclosure assembly, comprising:

a body having a tapered edge, the body defining an interior cavity configured to house electronics;

a pivot assembly coupled to the body on one end and providing a pivot coupler on another end, the pivot coupler being pivotable relative to the body; and a face plate selectively coupled to the pivot coupler with a fastener;

wherein the tapered edge of the body is configured to allow the body to pivot about the pivot assembly relative to the faceplate to an install position wherein the body can be positioned through a corner casting.

13. The enclosure assembly of claim 12, wherein the taper of the body is configured to allow the body to pivot relative to the face plate to a secured position wherein the face plate is positioned on an exterior side of the corner casting and the body is positioned on an interior side of the corner casting.

14. The enclosure assembly of claim 13, wherein the container tracking enclosure assembly is substantially fixed to the corner casting in the secured position.

15. The enclosure assembly of claim 12, wherein the fastener is coupleable to the pivot coupler at an install length and a secured length, wherein the body is sized to fit through an opening in a corner casting when the fastener is at the install length.

16. The enclosure assembly of claim 15, wherein the body is configured to be selectively locked in the secured position with the fastener at the secured length by compressing a portion of the corner casting between the face plate and the body.

17. The enclosure assembly of claim 12, further comprising a cap that is selectively coupleable to the body, the cap sized to substantially seal the interior cavity of the body when coupled thereto.

18. The enclosure assembly of claim 12, wherein the face plate has a convex profile configured to provide a minimal edge when coupled to the corner casting.

19. The enclosure assembly of claim 12, wherein the fastener has a security feature that requires a security tool to transition the fastener between the install length and secured length.

20. A method for installing a removeable container tracking enclosure assembly to a corner casting of a container, comprising:

coupling a face plate to a body through a fastener coupled to a pivot assembly, the fastener coupled to the pivot assembly at an install length;

pivoting the body relative to the face plate to an install position wherein the body has an offset angle relative to the face plate;

positioning the body through an opening in the corner casting while in the install position;

repositioning the body to a secured position wherein the face plate is positioned on an exterior side of the corner casting and the body is positioned on an interior side of the corner casting; and transitioning the fastener to a secured length within the pivot assembly to compress a portion of the corner casting between the face plate and the body.

* * * * *